US006176795B1

(12) United States Patent
Schullstrom

(10) Patent No.: US 6,176,795 B1
(45) Date of Patent: Jan. 23, 2001

(54) ALUMINUM BAT WITH IMPROVED CORE INSERT

(76) Inventor: Kevin A. Schullstrom, 1417 Daytona Rd., Forked River, NJ (US) 08731

( * ) Notice: Under 35 U.S.C. 154(b), the term of this patent shall be extended for 0 days.

(21) Appl. No.: 09/370,188

(22) Filed: Aug. 9, 1999

Related U.S. Application Data

(60) Provisional application No. 60/097,723, filed on Aug. 24, 1998.

(51) Int. Cl.[7] ..... A63B 59/06
(52) U.S. Cl. ..... 473/566; 473/520
(58) Field of Search ..... 473/566, 567, 473/564, 520, 521, 519, 318–322

(56) References Cited

U.S. PATENT DOCUMENTS 3,861,682 * 1/1975 Fujii ..... 473/566
3,963,239 * 6/1976 Fujii ..... 473/566
5,511,777 * 4/1996 McNeely ..... 473/566
5,676,610 * 10/1997 Bhatt et al. ..... 473/566
5,899,823 * 5/1999 Eggiman ..... 473/566

* cited by examiner

*Primary Examiner*—Mark S. Graham
(74) *Attorney, Agent, or Firm*—Stephen W. White

(57) ABSTRACT

A tube-shaped element that can be inserted within the hollow barrel portion of an aluminum softball bat will provide damping and spring characteristics to the softball bat with improved life. This tube-shaped element is made from heat-treated metals and formed with a top and bottom diameter substantially equivalent to the internal diameter of the softball bat and with a central portion somewhat larger in diameter. A series of holes is drilled along the periphery of the top and bottom ends and then a series of slits is cut longitudinally along the length of the middle portion, each slit travelling from a hole in the top end to a similar hole in the bottom end. These slits permit the element to be compressed so as to fit within the hollow-hitting portion of the softball bat. A plastic coating may be placed on the tube-shaped element or a foam may be foamed within the hollow portion in order to deaden the sounds.

5 Claims, 3 Drawing Sheets

ALUMINUM BAT WITH IMPROVED CORE INSERT

This application claims the benefit of provisional application No. 60/097,723, filed Aug. 24, 1998.

BACKGROUND OF THE INVENTION

1. Field of the Invention

This invention relates to hollow aluminum bats and more specifically to hollow aluminum softball bats and to an improved core insert placed within a portion of said hollow, aluminum softball bat. Still more specifically, this invention relates to a core insert that will enable the user to obtain greater impact and bat kinetic energy when striking a ball with the bat and will dampen the noise that can be associated therewith.

2. Description of the Prior Art

Aluminum softball bats are legion in number and design. Most aluminum softball bats are hollow and comprise a gripping handle portion and a barrel portion, with the barrel portion being larger in diameter than the gripping handle. This type of softball bat is conventionally manufactured by separately forming the gripping handle and barrel portion (the hitting portion) and then joining the handle to the barrel. It is desirable to hit the ball with the barrel portion of the bat and thus there have been a host of prior art devices that are can be added to the design and manufacture of these bats and that purport to improve the use thereof. These prior art elements are or can be added within the hollow core of the barrel portion element or, alternatively, they can be added somewhere else within or on the outside of the bat itself. These elements are said to conserve the kinetic energy during the swinging of the bat and transfer that energy to the ball as it is hit by the bat. Additionally, some of the prior art elements are said to aid in the rebounding of the ball off of the bat and thus are said to improve the distance which the ball will travel when hit by the bat. Foams and other fillers have also been used to fill up portions of the hollow aluminum bats and thus dampen the vibration and noise made when a hollow, aluminum bat strikes another object such as a softball. Still other elements, when added to the aluminum softball bat, are said to improve the elastic deflection of the bat and thus increase the power when the bat is used to hit a ball, for example. Some of these prior art elements are inserted within the hollow portion of the barrel and are either metal or plastic and are said to add some "spring" to the bat itself. Most of the prior art insert elements, however, suffer from great disadvantages and begin to lose the "spring" after considerable use. Thus, the ball will start to lose distance when the "spring" diminishes and there is a pressing need to provide an improved element that can be inserted within the hollow portion of the bat easily and will last longer and impart a greater amount of "spring" to the bat when used to strike a softball, for example.

SUMMARY OF THE INVENTION

It is an object of my invention to provide an element that can be inserted within a hollow, aluminum softball bat to provide damping and noise reduction and also to increase the kinetic energy that can be transmitted from the swinging bat to a ball. It is yet another object of my invention to provide a damping and noise reduction element and a kinetic energy transmitting element that has a longer life when used with an aluminum bat. These and yet other objects are achieved in an improved hollow aluminum softball bat insert element wherein said hollow aluminum softball bat comprises a gripping handle portion and a barrel softball hitting portion and wherein said improved bat insert element comprises a heat-treated metal tube element, said tube element having a cylindrical tube shape fitable within said barrel of said hollow bat after compression of said tube-shaped insert element, said tube-shaped insert element having a length, a top end and a bottom end, and a middle portion along the length thereof, said ends being insertable within said hollow bat in said barrel portion, said middle portion being larger than said hollow bat at said barrel portion, said tube-shaped insert element having a series of holes drilled around the top end and around the bottom end thereof and a series of slits longitudinally placed along the middle portion thereof connected to said holes, wherein said tube-shaped element is compressed so as to be insertable in the hollow barrel portion of said aluminum softball bat and provide dampening and spring characteristics thereto.

BRIEF DESCRIPTION OF THE DRAWINGS

Looking now specifically at the drawings, which show some, but not all of the characteristics of the device of my invention.

Figure 1:
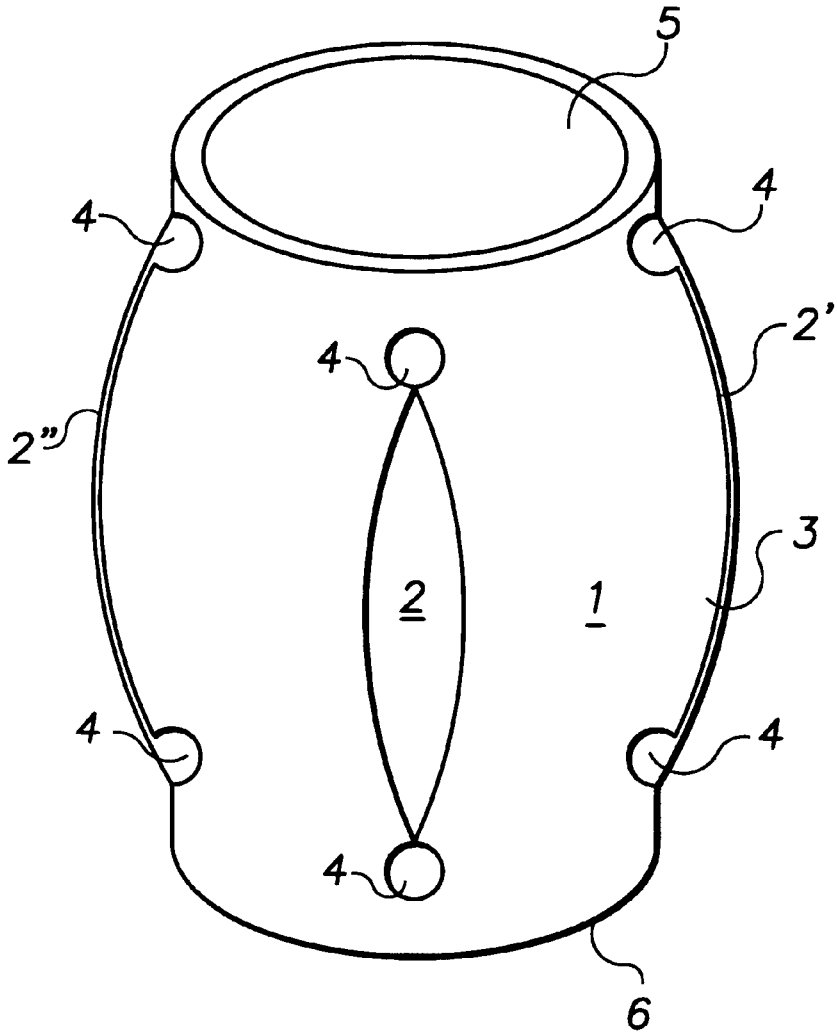
FIG. 1 is a side view of the tube-shaped, insert element of this invention wherein 1 is the tube-shaped insert element itself, 2 is one of the slits provided along the length of the middle portion 3 of the tube-shaped, insert element connected to holes 4. A series of holes also shown as 4 are drilled within the top end 5 and the bottom end 6. In this showing, there are six (6) holes visible and only one (1) slit, although two others can be partially seen at 2' and 2" and each of these slits is also associated with a pair of holts 4. I prefer that these slits, which are vertically cut along the length 3 of the tube-shaped, insert element of this particular showing, to be around six (6) or more in number, each with a pair of associated holes as shown. More or less can be either added or subtracted depending on the bat size, etc. The number of holes 4 can be from 6 to 22 with 10 being preferred, depending on the number of slits, two per slit, for example. One can plainly see that the top 5 and bottom 6 are substantially smaller in diameter than the middle portion 3 of the length of the tube element 1. The top and bottom openings 5 and 6 are designed to just fit within the barrel portion of the bat during the manufacture thereof.
Figure 2:
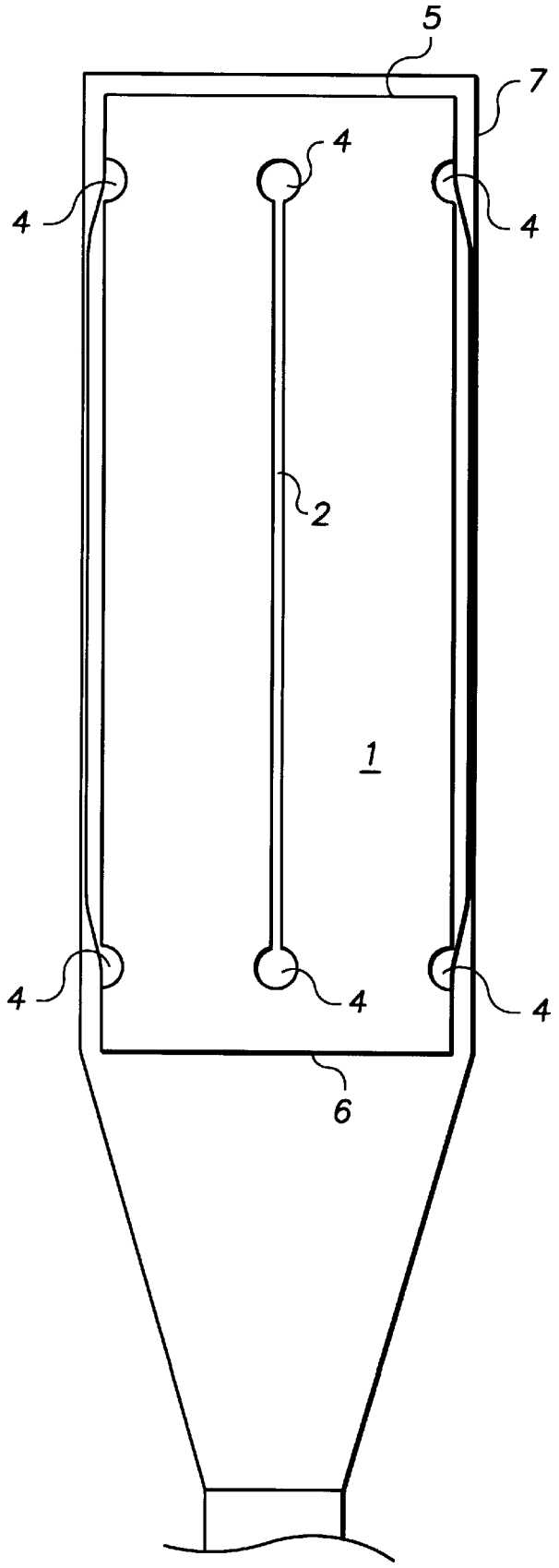
FIG. 2 shows the tube element 1 from FIG. 1 already inserted within the hollow barrel portion of an aluminum softball bat, for example. In this showing (side view and cutaway), the handle of the bat is not shown and 7 is the barrel portion which contains the tube-shaped, insert element 1 securely inside. Since the slits 2 and holes 4 provide considerable spring strength to the tube-shaped, insert element, is necessary to compress the center portion 3 of the tube-shaped, insert element in order to get it to fit within the hollow tube of the barrel portion of the aluminum softball bat. Both the top 5 and bottom 6 of the tube element will normally fit snuggly within the hollow barrel portion.
Figure 3:
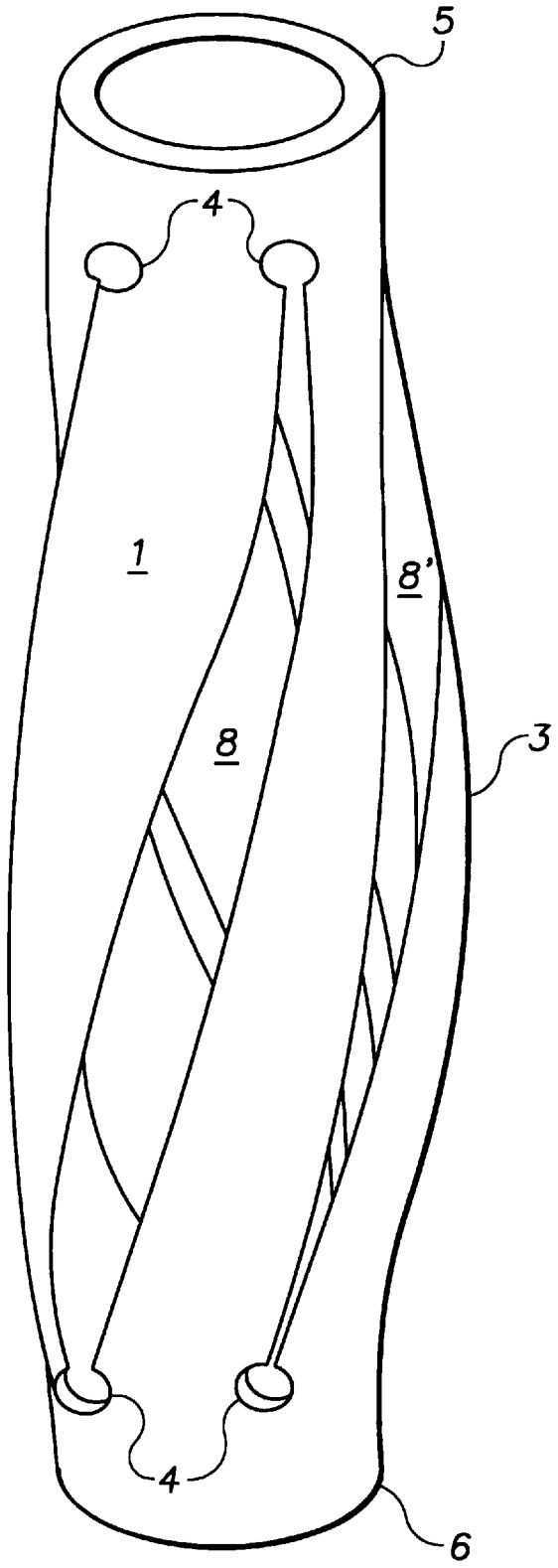
FIG. 3 is an alternative embodiment of the tube-shaped, insert element of this invention. In this particular showing, I again is the tube-shaped, insert element and 3 is the middle portion thereof. In this particular showing, the holes 4 (four shown here) are drilled through the top 5 and bottom 6. The slits shown as 8 and 8', are angular in nature instead of vertical as shown in FIG. 1. Once again, both holes 4 and slits 8 etc., may be more than are shown herein.

Before the tube element 1 shown in FIG. 1 is manufactured (metals preferred), the metal is then preferable heat treated to improve the strength of the spring characteristics and help retain the shape. A reactive, thermal set chemical co-polymer may be added as a coating to the entire tube-shaped, insert element and bonded to the surface thereof. This coating will provide an infusion coating, extra strength, and spring retention characteristics. Alternatively, and most preferred, a polyurethane foam (e.g. a polymeric diisocyanate polyol mixed with a hydrocarbon gas, for example), may be injected into the hollow portion of the tube-shaped insert element of this invention and allowed to foam up and cure. With either the polymeric coating on the surface or the foam insert within the device of this invention, there will be still sufficient compression characteristics thereto in order to provide that the device may be inserted within the barrel of the softball bat during the construction thereof After the bat is constructed, with my novel and improved device securely within the barrel of the bat, the entire bat will be dampened and provide a spring to the bat itself so that when a ball is hit with a bat containing this device, the ball will travel further. Additionally, since my device is manufactured from heat-treated metals and contains the various improvements described herein (e.g. holes, slits, copolymer coating or foam inserted within the hollow portion of the tube-shaped, insert element of this invention) the device will last longer and impart more desirable qualities than those of any prior art.

In a particularly preferred embodiment the tube-shaped, insert element of this invention is made from aluminum, although any number of metals may be used in place. These metals may include titanium, thin steel, composite metals, etc. These materials must be able to withstand a heat treating step and be thin enough so as to be compressible and thus fitable within the hollow portion of the barrel of a typical soft ball bat when being manufactured. High strength aluminum is particularly preferred since it is relatively inexpensive and is of the same composition as standard softball bat. In place of many of these conventional metals, plastic elements may be used instead, although a heat treatment step is not required for plastics.

The tube-shaped, insert element of this invention may be about 8 to 16 inches in length depending on the softball bat into which it is to be inserted. I prefer an element of about 12 inches in length with around 0.002 to 0.1 inches in thickness. As stated above, a plurality of holes are drilled around the top and bottom ends and a plurality of slits longitudinally connect these holes along the middle portion. The metals are normally heat treated prior to the fabrication of the element of this invention. These holes and slits, along with the heat treatment step, give the type-shaped, insert element of this invention a spring-like quality and facilitate the insertion within the barrel portion of the bat by compression. The tube-shaped, insert element is, prior to compression, around 1 in. to 10 in. in diameter in the top 5 and bottom 6 and around 2 in. to 10 in. within the middle portion 3. Since the hollow portion of a conventional metal softball bat is around 2¼ in. to 11 in. inside diameter so that when the tube-shaped, insert element of this invention is suitably compressed, it will fit neatly within the hollow portion of the barrel portion of the softball bat. Normally, my device is placed up within the hitting portion of the barrel of the softball bat, which includes most of the portion extending just above the handle thereof and is usually 10 in. to 24 in. in length.

As mentioned above, the metals used the element of this invention is normally heat treated prior to making the tube-shaped, insert element of this invention. Heat treating may be accomplished by any of a plurality of prior art methods, such as by heating by flame or putting in an oven to heat up the material followed by a cool-down time wherein extra strength will be imparted thereto.

A lubricant may be added if necessary. Such lubricants will enhance the sliding of the tube-shaped, insert of this invention within the barrel of the softball bat, although this is not necessary. If necessary, a small weld can be added to a metal tube-shaped, insert of this invention in order to keep the device within the barrel of the bat, although this also is not necessary to provide the effect of this invention as described.

Softball bats containing the tube-shaped, insert of this invention, placed within the barrel portion of the softball bat, will perform in an unusual manner permitting the user to get increased distance and strength while striking a softball. Additionally, the device of this invention, because of the unusual characteristics described herein, will have a long life of use and thus has greater utility than any prior art element here-to-for described.

I claim:

1. An improved hollow aluminum softball bat insert element adapted to be used with a softball bat wherein said softball bat comprises a gripping handle portion and a striking barrel portion and wherein said improved bat insert element comprises a metal tube element, said tube element having a cylindrical tube shape fitable within said barrel portion of said softball bat after compression of said tube-shape insert element, said tube-shaped insert element having a length, a top end and a bottom end, and a middle portion along the length thereof, said ends being insertable within said softball bat in said barrel portion, said middle portion being larger than said softball bat at said barrel portion, a series of holes drilled around the top end and bottom end thereof, and a series of slits longitudinally along the middle portion and connecting said holes, wherein said metal is heat treated to provide strength and spring retention capabilities prior to forming said tube element and said tube element is compressed so as to be insertable in the hollow barrel portion of said softball bat and provide dampening and spring characteristics thereto.

2. The tube-shaped, insert element of claim 1 wherein a polyurethane foam is foamed within said tube-shaped, insert element prior to inserting within said softball bat.

3. The tube-shaped, insert element of claim 1 wherein a coating co-polymer coating is applied thereto prior to inserting within said softball bat.

4. The tube-shaped, insert element of claim 2 wherein said metal is aluminum and said element has a diameter of between 2 in. and 3 in. at the top and bottom ends and a diameter of between 2 in. and 10 in. in the middle portion prior to compression and insertion within said softball bat.

5. The tube-shaped, insert element of claim 1 wherein a lubricant is added on the surface thereof prior to insertion into the hollow barrel portion of said aluminum softball bat.

* * * * *